US006616272B1

(12) United States Patent
Hsu et al.

(10) Patent No.: US 6,616,272 B1
(45) Date of Patent: Sep. 9, 2003

(54) PRESSURE CONTROL DEVICE

(75) Inventors: Cheng-Wei Hsu, Tainan (TW); I-Chung Hou, Hsinchu (TW)

(73) Assignee: International United Technology Co., Ltd., Hsin-Chu (TW)

( * ) Notice: Subject to any disclaimer, the term of this patent is extended or adjusted under 35 U.S.C. 154(b) by 0 days.

(21) Appl. No.: 10/064,210

(22) Filed: Jun. 21, 2002

(30) Foreign Application Priority Data

Mar. 7, 2002 (TW) ..... 91202654 U

(51) Int. Cl.[7] ..... M41J 2/175
(52) U.S. Cl. ..... 347/87; 347/86
(58) Field of Search ..... 347/85, 86, 87

(56) References Cited

U.S. PATENT DOCUMENTS 5,719,609 A * 2/1998 Hauck et al. ..... 347/85
5,917,523 A * 6/1999 Baldwin et al. ..... 347/85
5,988,803 A * 11/1999 Komplin et al. ..... 347/86
6,151,052 A * 11/2000 Yang et al. ..... 347/87
6,186,620 B1 * 2/2001 Hsieh et al. ..... 347/84
6,213,598 B1 * 4/2001 Hou et al. ..... 347/86

* cited by examiner

*Primary Examiner*—Anh T.N. Vo
(74) *Attorney, Agent, or Firm*—Jiang Chyun IP Office

(57) ABSTRACT

A pressure control device installed inside an ink reservoir. The ink reservoir further includes a pressure regulator. The pressure control device at least includes a nozzle stand, a plugging block and a spring-loaded structure. The nozzle stand is attached to the bottom wall of the ink reservoir. The nozzle stand further includes a nozzle hole for linking up the interior of the ink reservoir with the exterior. The nozzle stand has a groove near the upper end of the nozzle. The plugging block is placed inside the groove for partitioning the interior of the ink reservoir from the exterior. The spring-loaded structure has a first section and a second section that connect with each other. The first section presses against the outer edge of the plugging block with an elastic force. The pressure regulator pushes the second section and lifts the first section away from the outer edge of the plugging block. A limiting structure may also be installed somewhere crossing the path of movement of the spring-loaded structure so that the range of movement of the spring-loaded structure is confined.

14 Claims, 11 Drawing Sheets

PRESSURE CONTROL DEVICE

CROSS REFERENCE TO RELATED APPLICATIONS

This application claims the priority benefit of Taiwan application serial no.91202654, filed Mar. 7, 2002.

BACKGROUND OF INVENTION

1. Field of Invention

The present invention relates to a pressure control device. More particularly, the present invention relates to a pressure control device inside the ink reservoir of an inkjet module.

2. Description of Related Art

In general, the print head of an inkjet printer has some mechanism for controlling the flow of ink from an ink reservoir to print media. To prevent ink from leaking out of the print head, a partial vacuum is usually created inside the ink reservoir so that the air pressure inside the reservoir is slightly smaller than external atmospheric pressure. Hence, a negative pressure permanently exists inside the ink reservoir and leakage of ink is prevented. Note that if the negative pressure inside the reservoir is too high, the inkjet print head may not provide sufficient force to spread out the ink. Thus, the negative pressure inside the ink reservoir must be maintained within a definite range for normal operation of the print head.

However, due to constant fluctuation of atmospheric pressure, negative pressure inside the ink reservoir changes correspondingly. To maintain the negative pressure within a defined range, a number of pressure regulators have been developed. For example, one such pressure regulator for controlling the negative pressure inside an ink reservoir is disclosed in Taiwan Patent No. 438684 (U.S. Pat. No. 6,213,598).

FIGS. 1A and 1B are schematic cross-sectional views showing a portion of the internal layout of a pressure regulator as described in U.S. Pat. No. 6,213,598. As shown in FIGS. 1A and 1B, an air bag 136 is installed inside an ink reservoir 110. The air bag 136 is connected to the external atmosphere through a pipeline 138 so that internal volume of the ink reservoir 110 may increase or decrease by expanding or contracting the air bag 136. Ultimately, pressure inside the ink reservoir 110 also changes. Using this mechanism, negative pressure inside the ink reservoir is maintained within a permitted range. However, the air bag 136 must encounter a limit to expansion. When most of the ink inside the reservoir is used and the air bag has expanded so much that the negative pressure inside the ink reservoir is no longer regulated by the air bag 136, negative pressure inside the ink reservoir gradually rises. To bring down the negative pressure again, a pressure control device 200 is often fitted inside the ink reservoir 110 so that external gases may rush into the ink reservoir 110 to increase the gas pressure inside the ink reservoir 110. Hence, negative pressure inside the ink reservoir 110 is lowered and internal pressure is maintained within a permitted range.

As shown in FIG. 1A, the pressure control device 200 further includes a vent 210, a plugging block 220 and a spring-loaded structure 230. The vent 210 includes a hole 212 and a groove 214. The hole 212 is a connective channel linking up both the interior and the exterior of the ink reservoir 110. Furthermore, the groove 214 is at the upper end of the hole 212 while the plugging block 220 is placed inside the groove 214. A first section 230*a* of the spring-loaded structure 230 presses against the upper portion of the plugging block 220 so that the plugging block 220 seals the hole. Hence, the interior of the ink reservoir 110 is isolated from the exterior. The plugging block 220 can be a spherical body such as a steel ball. When the air bag 36 continues to expand and moves a plate 134 in the B direction, the plate 134 pushes against a second section 230*b* of the spring-loaded structure 230 as shown in FIG. 1B. In the meantime, such movement in the second section 230*b* of the spring-loaded structure 230 raises the first section 230*a* of the spring-loaded structure 230. Ultimately, the first section 230*a* of the spring-loaded structure 230 no longer comes in contact with the upper edge of the plugging block 220.

Since air pressure outside the ink reservoir 110 is greater than internal air pressure, an external pressure will exert on the plugging block 220 through hole 212 trying to raise the plugging block 220. This will increase the air pressure inside the ink reservoir 110 and lower the negative pressure that exists between the interior and exterior of the ink reservoir 110. The spring 132 of a pressure regulator 130 compresses the air sac 136 by exerting a force against the pressure plate 134 in direction A as shown in FIG. 1A. However, when the plate 134 no longer touches the second section 230*b* of the spring-loaded structure 230, the first section 230*a* of the spring-loaded structure 230 will return to an elastic state pressing against the upper edge of the plugging block 220. Consequently, the plugging block 220 returns to the original position sealing the nozzle hole at the upper end of hole 212 and restores the partition between the interior and exterior of the ink reservoir 110.

As shown in FIGS. 1A and 1B, the spring-loaded structure 230 of a conventional pressure control device 200 is a piece of metallic strip. When the pressure plate 134 of the pressure regulator 130 exerts too much pressure on the second section 230*b* or the ink module 100 vibrates too much, the first section 230*a* is raised to a high level moving the first section 230*a* away from the plugging block 220. Thus, the first section 230*a* is unable to hold the plugging block 220 in position any longer. Sometimes, the plugging block 220 may jump out of the groove 214 forever so that the nozzle 212 is no longer sealed. In other words, the pressure control device 200 no longer works in tandem with the pressure regulator 130 to provide necessary negative pressure adjustment inside the ink reservoir 110.

SUMMARY OF INVENTION

Accordingly, one object of the present invention is to provide a pressure control device capable of maintaining the negative pressure inside an ink reservoir within a definite range and limiting the moving range of an internal spring-loaded structure, in particular, the moving range of a first section of the spring-loaded structure so that the dislodging of a plugging block from functional position is prevented and pressure control is always maintained.

To achieve these and other advantages and in accordance with the purpose of the invention, as embodied and broadly described herein, the invention provides a pressure control device installed inside an ink reservoir. The pressure control device sets up a negative pressure between the interior and the exterior of the ink reservoir. The ink reservoir further includes a pressure regulator. The pressure control device at least includes a vent, a plugging block and a spring-loaded structure. The vent is positioned inside the interior wall of the ink reservoir. The vent has a groove near the upper end of the hole. The plugging block is placed within the groove for partitioning the ink reservoir into an interior and an exterior. The spring-loaded structure is also set up within the interior wall of the ink reservoir. The spring-loaded structure has a first section and a second section. The first section presses against the outer edge of the plugging block and exerts an elastic force on the plugging block. The second section is coupled to the pressure regulator so that any change in negative pressure is transformed into a corresponding movement of the second section of the spring-loaded structure. In this way, the first section of the spring-loaded structure is detached from the outer edge of the plugging block.

To prevent the first section of the spring-loaded structure from moving too far away from the plugging block so that the plugging block may jump out of the groove, the spring-loaded structure includes a third section connected to the second section of the spring-loaded structure. One end of the third section runs in a direction parallel to the movement of the pressure regulator and extends towards the interior sidewall of the ink reservoir yet is detached from the interior wall of the ink reservoir, thereby limiting the range of movement of the third section. Hence, the range of movement of the second section and the second section are also restricted.

Similarly, to prevent the first section of the spring-loaded structure from moving too far away from the outer edge of the plugging block and jumping out of the groove, a limiting structure may be set up somewhere along the moving trajectory of the first section of the spring-loaded structure. Hence, the first section of the spring-loaded structure is free to move within a definite range only.

By the same token, to prevent the first section of the spring-loaded structure from moving too far away from the outer edge of the plugging block and jumping out of the groove, the spring-loaded structure may further include an additional third section. The third section corresponds with another limiting structure inside the ink reservoir that confines the movement of the third section. Ultimately, the first section of the spring-loaded structure is free to move within a definite range only.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

Figure 1A:
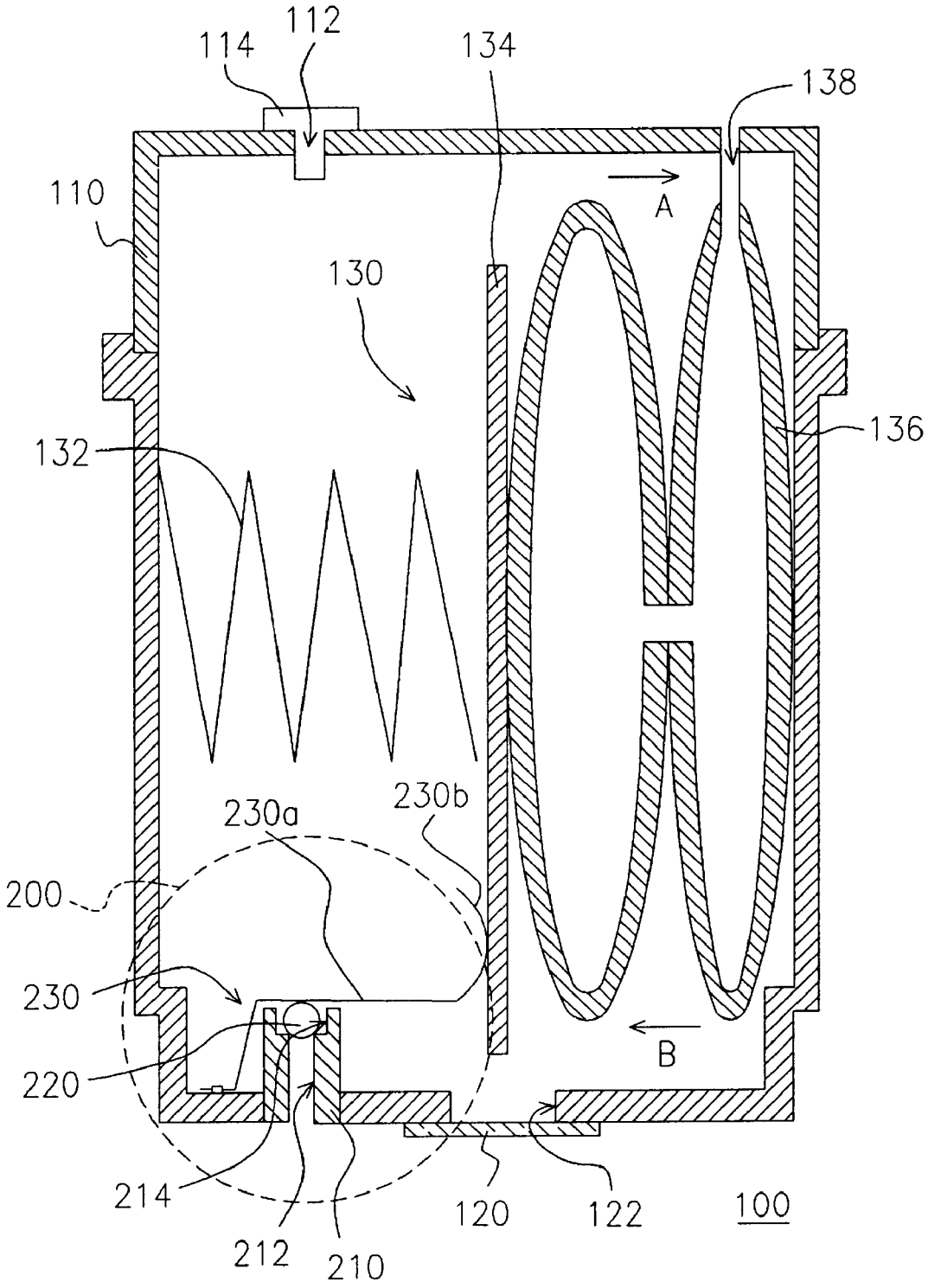
FIG. 1A (PRIOR ART)
FIGS. 1A and 1B are schematic cross-sectional views showing a portion of the internal layout of a pressure control device according to a conventional design.
Figure 1B:
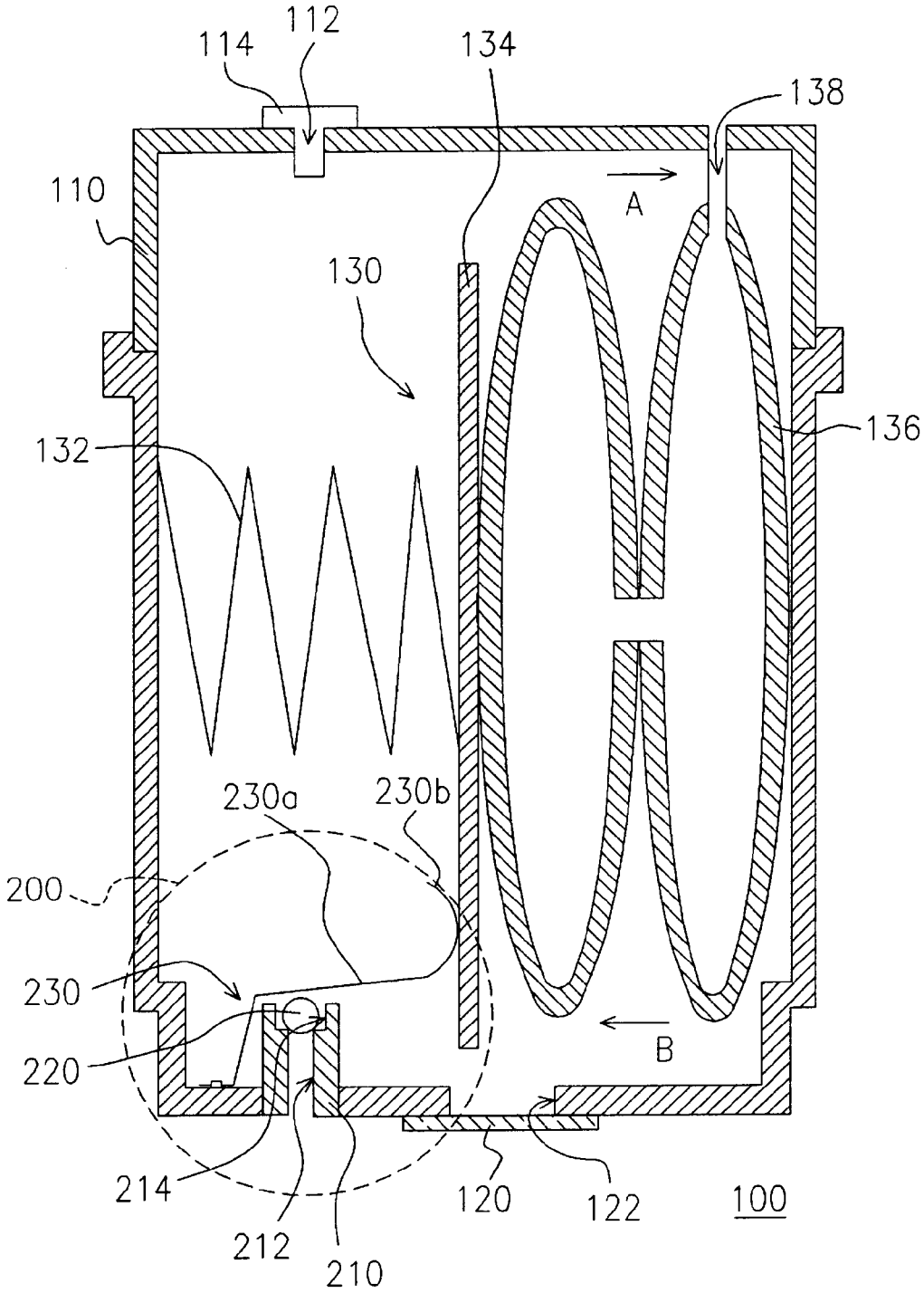
FIG. 1B (PRIOR ART)

Reference will now be made in detail to the present preferred embodiments of the invention, examples of which are illustrated in the accompanying drawings. Wherever possible, the same reference numbers are used in the drawings and the description to refer to the same or like parts.

Figure 2A:
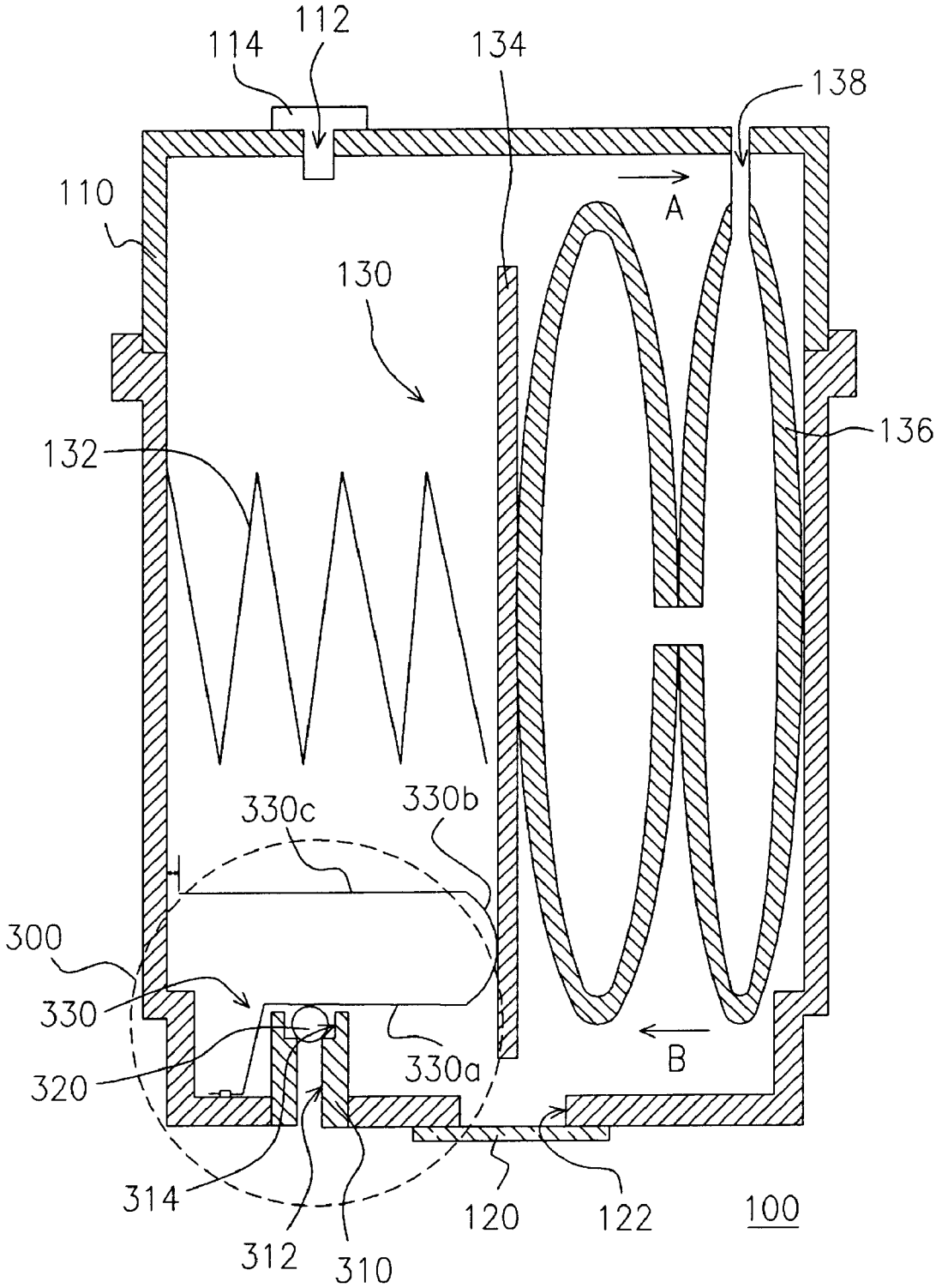
FIGS. 2A and 2B are schematic cross-sectional views showing a pressure control device applied to an inkjet module according to a first embodiment of this invention.
Figure 2B:
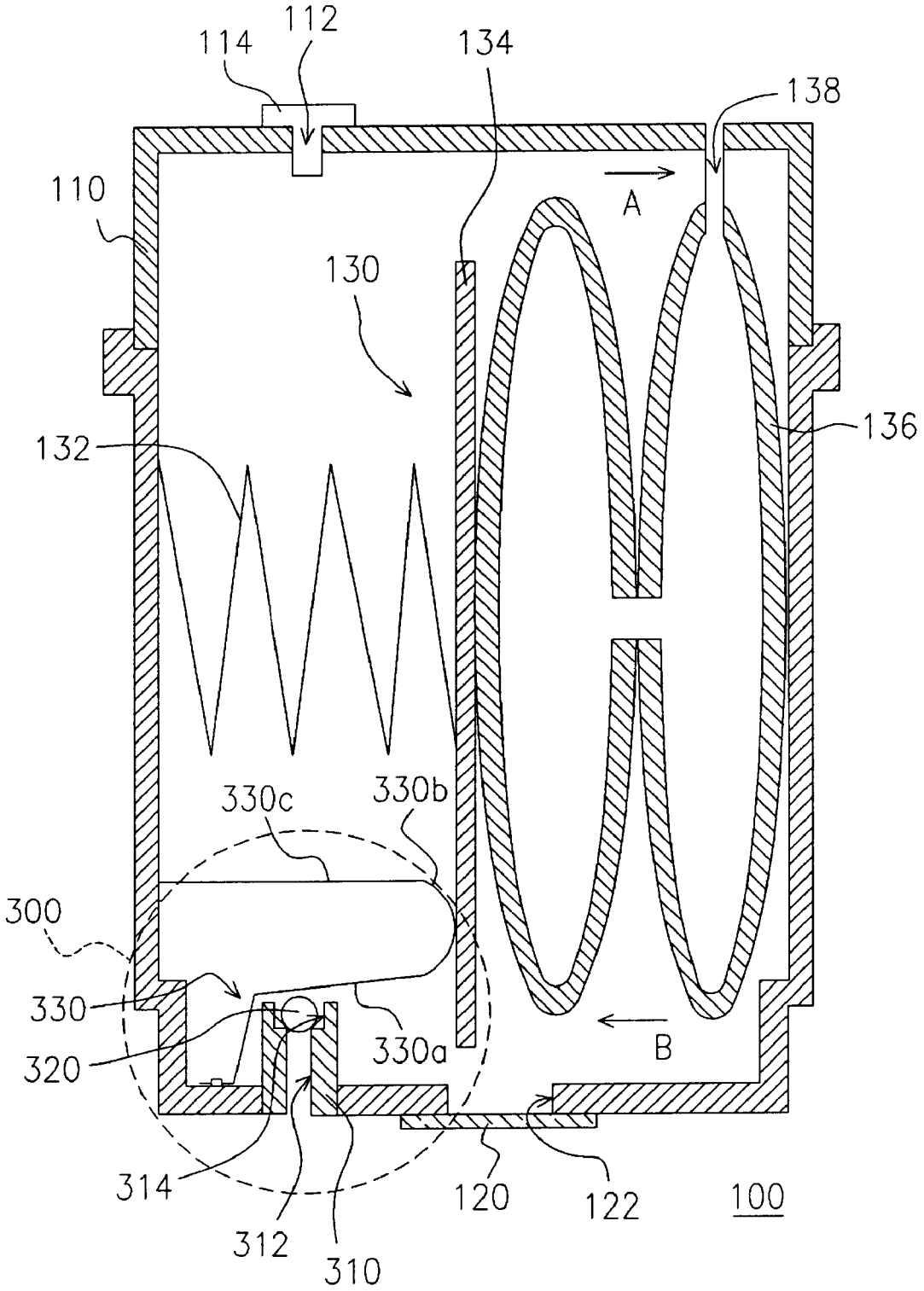

FIGS. 2A and 2B are schematic cross-sectional views showing a pressure control device applied to an inkjet module according to a first embodiment of this invention. As shown in FIGS. 2A and 2B, the inkjet module 100 mainly comprises of an ink reservoir 110 and an inkjet print head 120. The ink reservoir 110 is a sealed container and the inkjet print head 120 is located at the bottom of the ink reservoir 110. The print head 120 connects with the interior of the ink reservoir 110 through an ink channel 122. Hence, after injecting some ink into the ink reservoir 110 through an ink inlet port 112, the inlet port 112 is sealed by a cylindrical plug 114. Thereafter, ink drops may spray out on the surface of a paper when driven by print head 120. In addition, a pressure regulator 130 is installed inside the ink reservoir 110. The pressure regulator 130 comprises a spring 132, a plate 134 and an air bag 136. The air bag 136 is connected to the outside through a pipeline 138. Note that air pressure inside the ink-reservoir 110 is slightly smaller than the atmospheric pressure outside the ink reservoir 110 so that a negative pressure exist between the interior and the exterior of the ink reservoir 110. This negative pressure holds back the ink and prevents the ink from leaking out of the inkjet print head 120.

The pressure control device 300 according to the first embodiment of this invention is installed inside the ink reservoir 110. The pressure control device 300 mainly includes a vent 310, a plugging block 320 and a spring-loaded structure 330. The vent 310 is set up on the bottom wall of the ink reservoir 110. The vent 310 has a hole 312 that links up the interior and the exterior of the ink reservoir 110. The vent 310 further includes a groove 314 near the upper end of the hole 312. The plugging block 320 is stationed inside the groove 314 over the upper end of the hole 312 so that the interior and exterior of the ink reservoir 110 are separated. The plugging block can be a spherical body such as a steel ball or other material capable of blocking the nozzle hole. The spring-loaded structure 330 is made up of three sections, a first section 330*a*, a second section 330*b* and a third section 330*c*. The first section 330*a*, the second section 330*b* and the third section 330*c* are connected with each other in turn. The first section 330*a* presses elastically on the outer edge of the plugging block 320 to ensure a permanent seal at the upper end of the nozzle 320 by the plugging block 320. The second section 330*b* couples with the plate 134 of the pressure regulator 130. Hence, when the negative pressure inside the ink reservoir 110 changes, the pressure plate 134 will push the second section 330*b* of the spring-loaded structure 330 forward and raise the first section 330*a* of the spring-loaded structure 330. Hence, the first section 330*a* starts to detach from the outer edge of the plugging block 320 and permits the entrance of air into the interior of the ink reservoir 110. Together with pressure adjustment of the pressure regulator 130, negative pressure inside the ink reservoir 110 will return back to a desired range.

As shown in FIG. 2A, if the plate 134 of the pressure regulator 130 pushes too hard on the second section 330*b* of the spring-loaded structure 330 due to a rise in external pressure or vibration, the first section 330*a* may be raised too high. Under such circumstances, the first section 330*a* of the spring-loaded structure 330 may move too far away from the plugging block 320 so that the first section 330*a* and the groove 314 can no longer hold the plugging block 320 in position. Consequently, the plugging block 320 may jump out of the groove 314.

To prevent the first section 330*a* of the spring-loaded structure 330 from moving too far from the outer edge of the plugging block 320, the pressure control device 300 has a third section 330*c* in the spring-loaded structure 330 attached to the second section 330*b*. One end of the third section 330*c* is parallel to the direction of movement of the pressure regulator 130 (direction B) and extends towards the interior sidewall of the ink reservoir 110 yet is detached from the sidewall by a short distance. Note that the distance between the end of the third section 330*c* and the interior wall of the ink reservoir 110 must be set such that maximum distance between the first section 330*a* and the upper end of the vent 310 is smaller than the outer diameter of the plugging block 320. This condition prevents the plugging block 320 from jumping out of the groove 314 through the gap between the first section 330*a* and the groove 314. Hence, the plugging block 320 is functionally stabilized.

The pressure control device according to the first embodiment of this invention utilizes a third section connected to a second section of a spring-loaded structure to limit the movement of a first section. The third section runs along the moving direction of the second section and extends towards the interior sidewall of the ink reservoir but without touching the wall. This arrangement limits the range of movement of the third section. Consequently, when negative pressure inside the ink reservoir changes and the pressure regulator pushes the second section of the loaded structure towards the interior wall, moving range of the third section is restricted. This restricts the moving range of both the first section and the second section correspondingly. The range of movement of the third section is set such that the maximum gap between the first section and the upper end of the vent is smaller than the diameter of the plugging block so that the position of the plugging block is prevented from jumping off.

In a second embodiment of this invention, the pressure control device includes a limiting structure that limits the range of movement, in particular, the first section of a spring-loaded structure.

Figure 3:
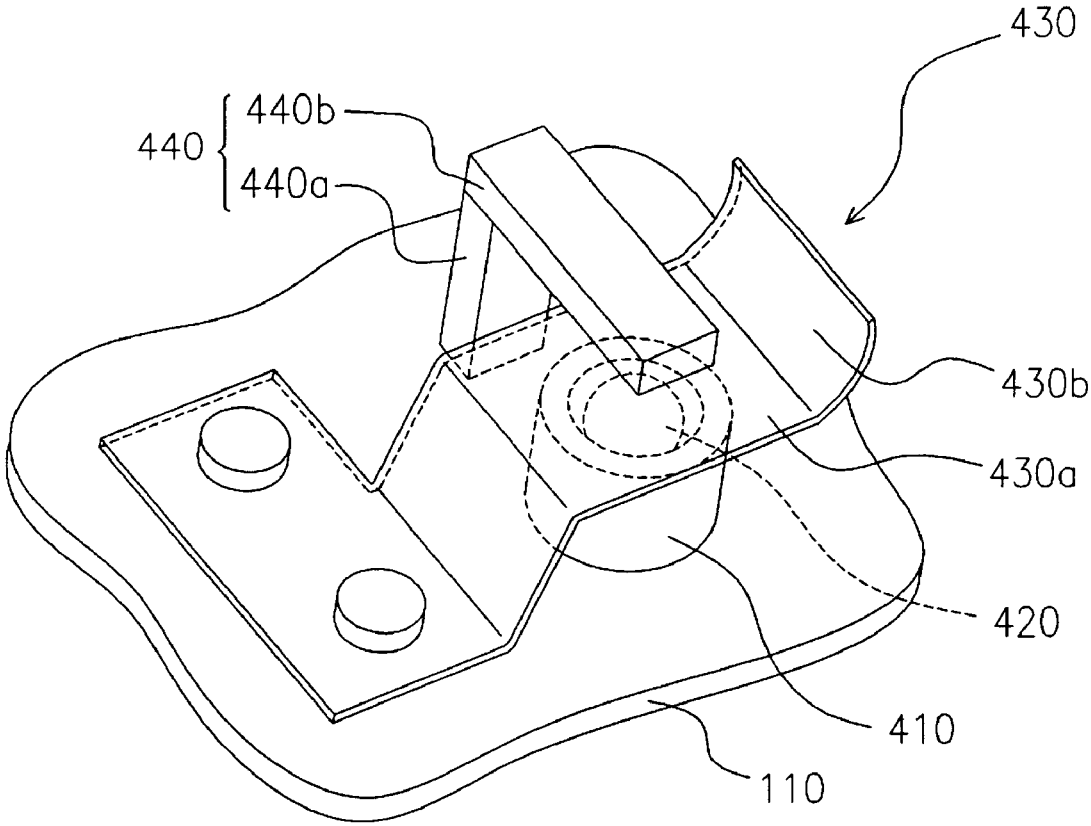
FIG. 3 is a perspective view of a portion of a pressure control device according to a second embodiment of this invention.
Figure 4A:
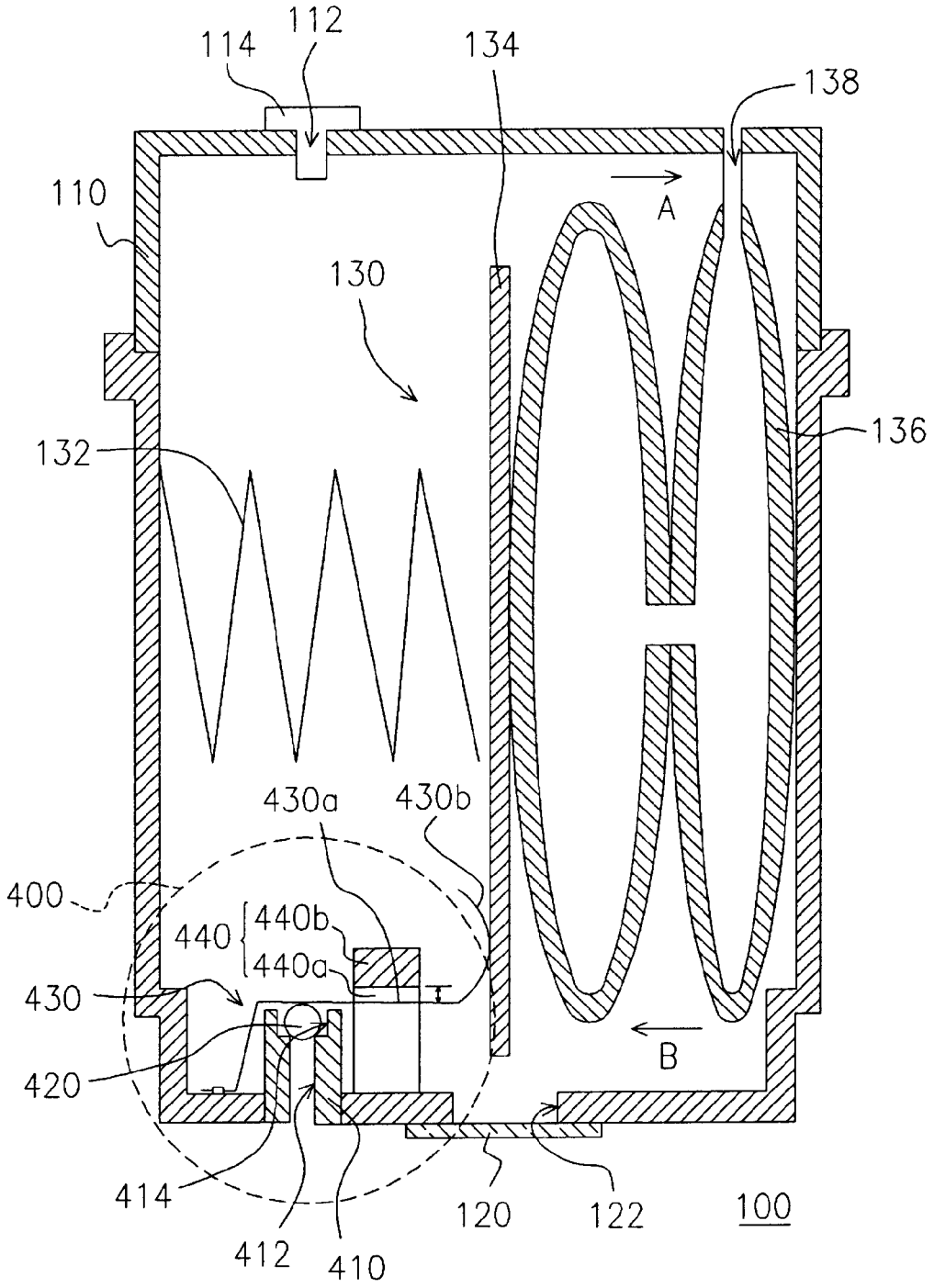
FIGS. 4A and 4B are schematic cross-sectional views showing a pressure control device applied to an inkjet module according to the second embodiment of this invention.
Figure 4B:
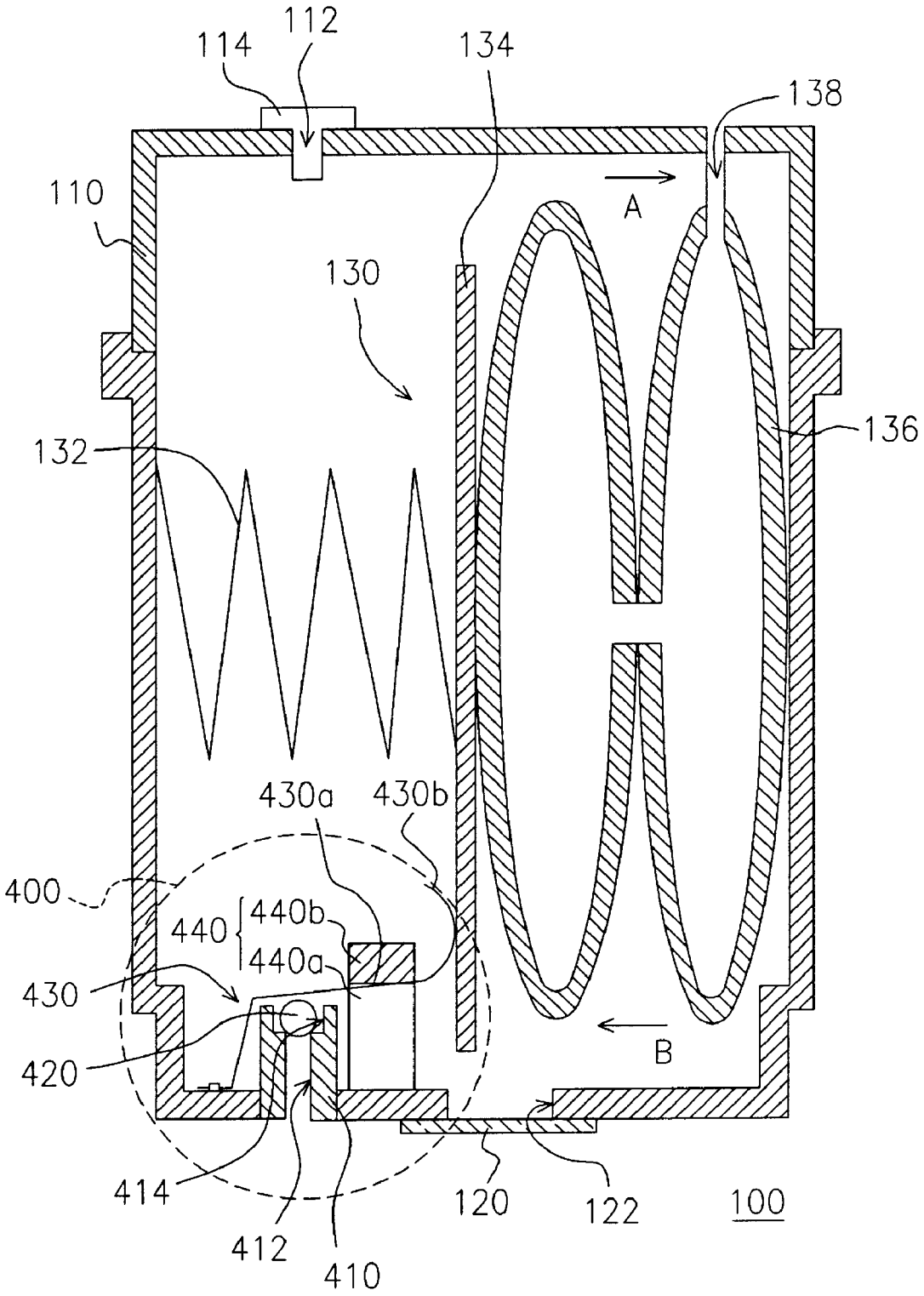

FIG. 3 is a perspective view of a portion of a pressure control device according to a second embodiment of this invention. FIGS. 4A and 4B are schematic cross-sectional views showing a pressure control device applied to an inkjet module according to the second embodiment of this invention. The pressure control device 400 includes a limiting structure 440 setup along the trajectory of movement of the spring-loaded structure 430, especially a first section 430*a* of the spring-loaded structure 430.

Hence, the range of movement of the first section 430*a* is confined. As shown in FIG. 3, the limiting structure 440 is made up of a pad block 440*a* and a stopper block 440*b*. The pad block 440*a* is attached to the interior sidewall of the ink reservoir 110 and may be manufactured as an integrative unit together with the ink reservoir 110. One end of the stopper block 440*b* is joined to the upper end of the pad block 440*a* while the other end of the stopper block 440*b* extends outwards towards the moving path of the first section 430*a*.

As shown in FIG. 4A, distance of separation between the stopper block 440*b* and the first section 430*a* is set such that the maximum separation between the first section 430*a* and the upper end of the vent 410 is smaller than the outer diameter of the plugging block 420. With this arrangement, the plugging block 420 is prevented from jumping off the groove 414 through the gap between the groove 414 and the first section 430*a*. Hence, the plugging block 420 is functionally stabilized. However, a limiting structure 440 constructed using the pad block 440*a* and the stopper block 440*b* is not the only construction possible. Other structural arrangements are also possible as long as the structure can effectively restrain the movement of the first section 430*a* within a definite range.

In the second embodiment, the pressure control device incorporates a limiting structure. When negative pressure inside the ink reservoir changes, the pressure regulator pushes the second section of the spring-loaded structure forward. The limiting structure is set along the trajectory of the spring-loaded structure, in particular, the first section so that the first section is confined to move within limits. Confinement of the first section limits the maximum separation between the first section and the upper end of the nozzle stand to a value smaller than the outer diameter of the plugging block. Consequently, the plugging block is stabilized in position and prevented from jumping off.

In a third embodiment of this invention, the pressure control device has a spring-loaded structure having a third section. The pressure controller provides a limiting structure that limits the movement of this third section.

Figure 5A:
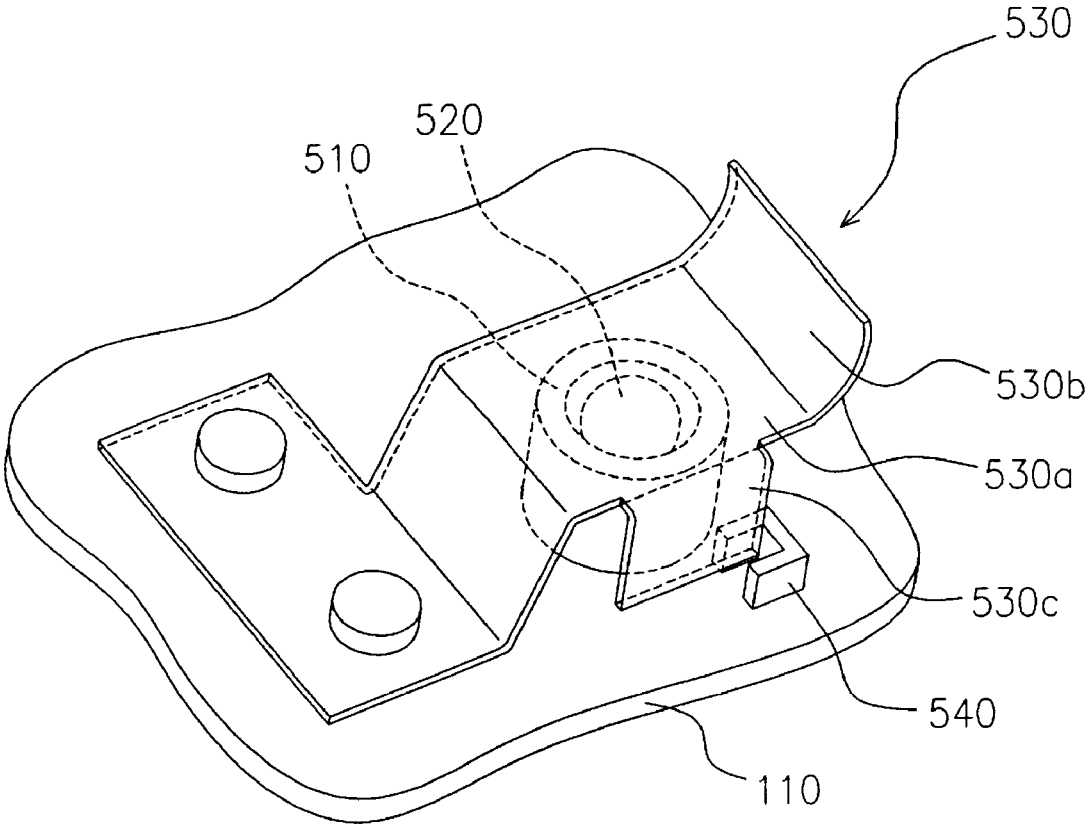
FIGS. 5A and 5B are perspective views of a portion of a pressure control device according to a third embodiment of this invention.
Figure 6A:
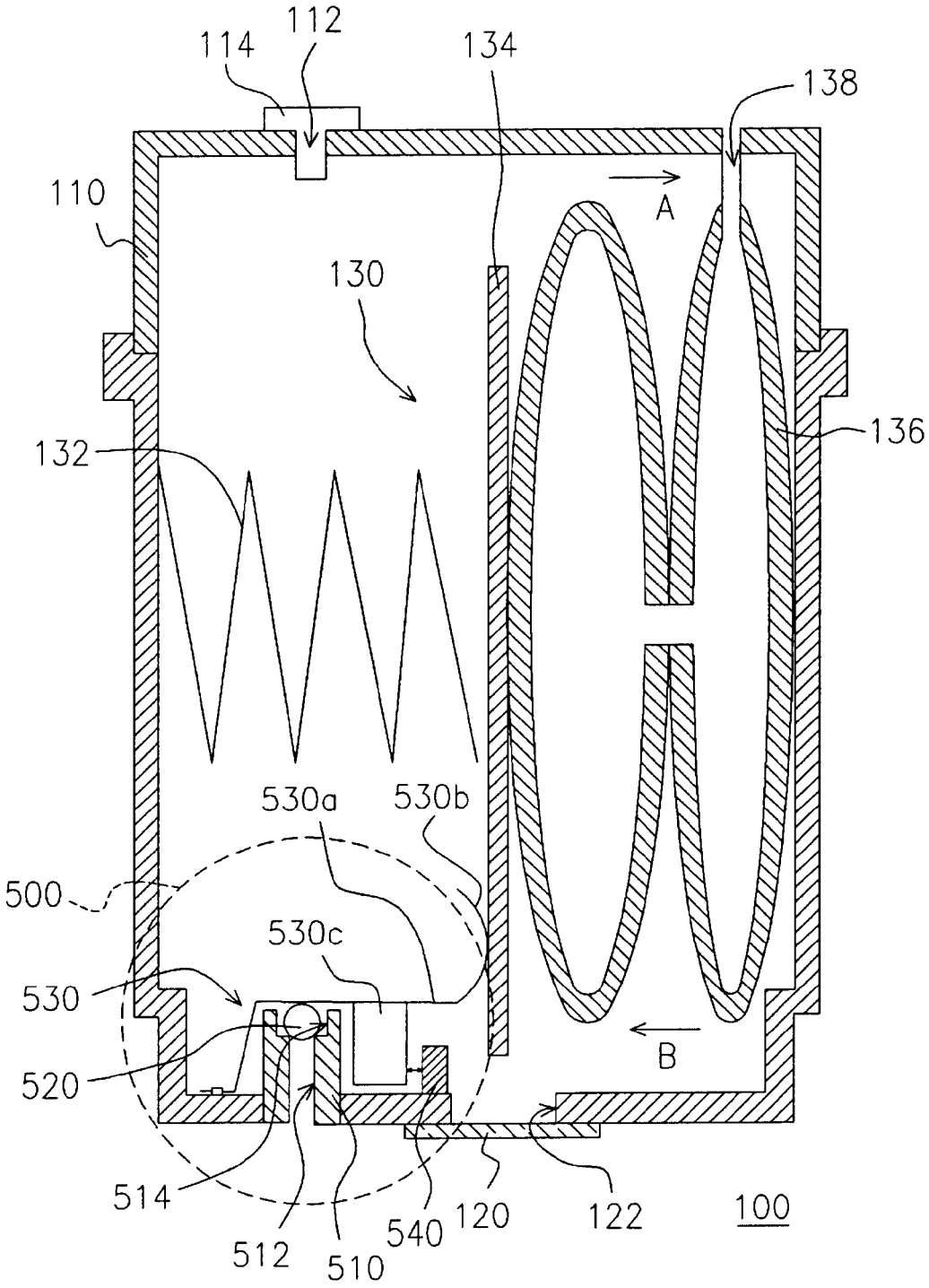
FIGS. 6A and 6B are schematic cross-sectional views showing a pressure control device applied to an inkjet module according to the third embodiment of this invention.
Figure 6B:
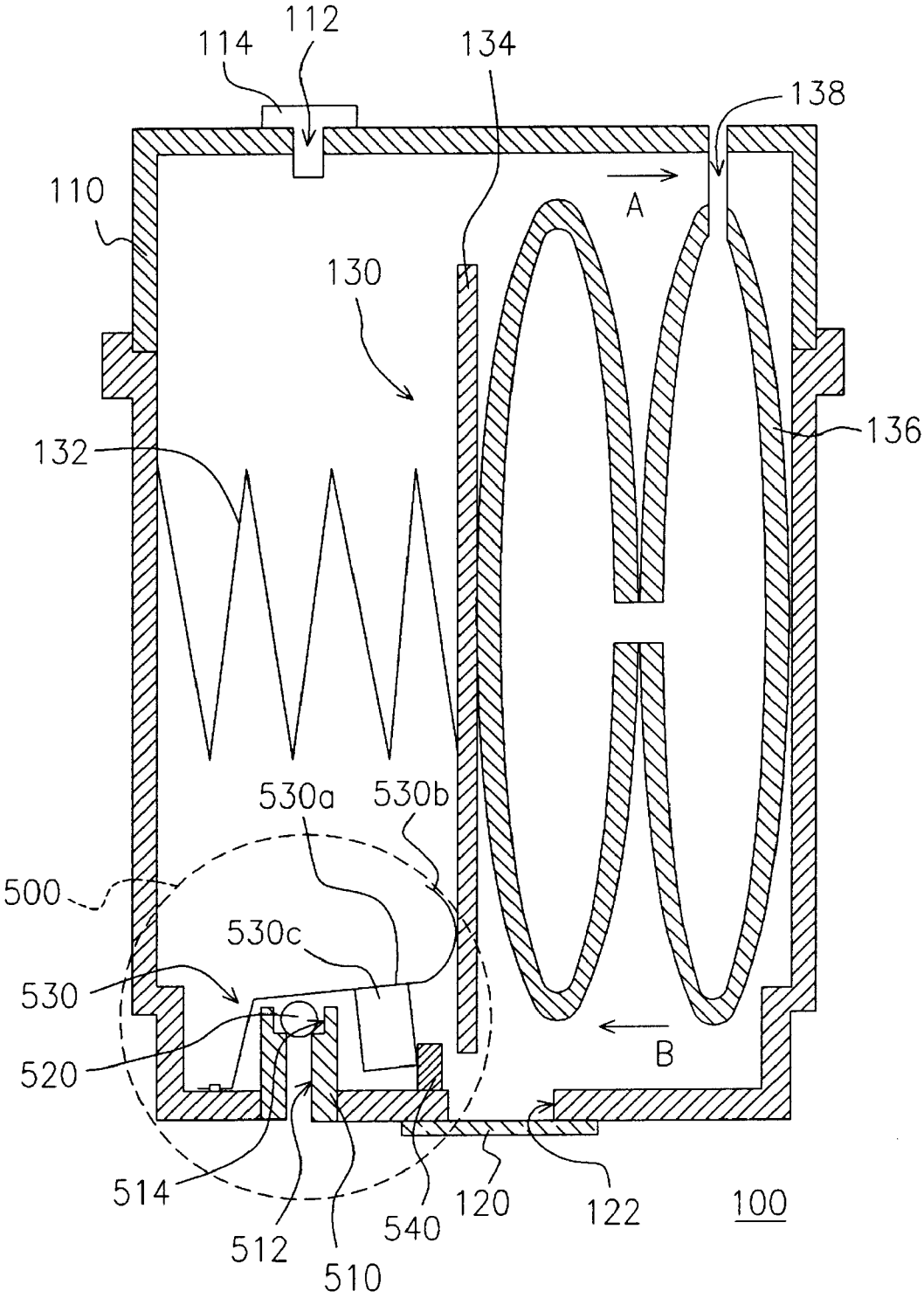

FIGS. 5A is a perspective view of a portion of a pressure control device according to a third embodiment of this invention. FIGS. 6A and 6B are schematic cross-sectional views showing a pressure control device applied to an inkjet module according to the third embodiment of this invention. The spring-loaded structure 530 of a pressure control device 500 has a third section 530*c* that differs from the third section 330*c* in the first embodiment. The third section 530*c* attaches to one side of the first section 530*a* (as shown in FIG. 5A) and extends downwards towards the bottom of the ink reservoir 110. In other words, the third section 530*c* is a side wing attached to the side edge of the first section 530*a* that bends down towards the floor of the ink reservoir 110. In addition, a limiting structure 540 is installed inside the ink reservoir 110 positioned somewhere along the moving path of the third section 530*c*. The limiting structure 540 may be manufactured together with the ink reservoir 110 as an integrative unit.

As shown in FIG. 6A, the distance of separation between the limiting structure 540 and the third section 530*c* is set such that the maximum separation between the first section 530*a* and the upper end of the vent 510 is smaller than the outer diameter of the plugging block 520. With this arrangement, the plugging block 520 is prevented from jumping off the groove 514 through the gap between the groove 514 and the first section 530*a*. Hence, the plugging block 520 is functionally stabilized. Note that the spring-loaded structure 530 is a metallic strip formed by a punching operation. Hence, the third section 530*c* together with the rest of the spring-loaded structure 530 may be fabricated in the same punching process. Ultimately, production cost and production time of the third section 530*c* is reduced.

Figure 5B:
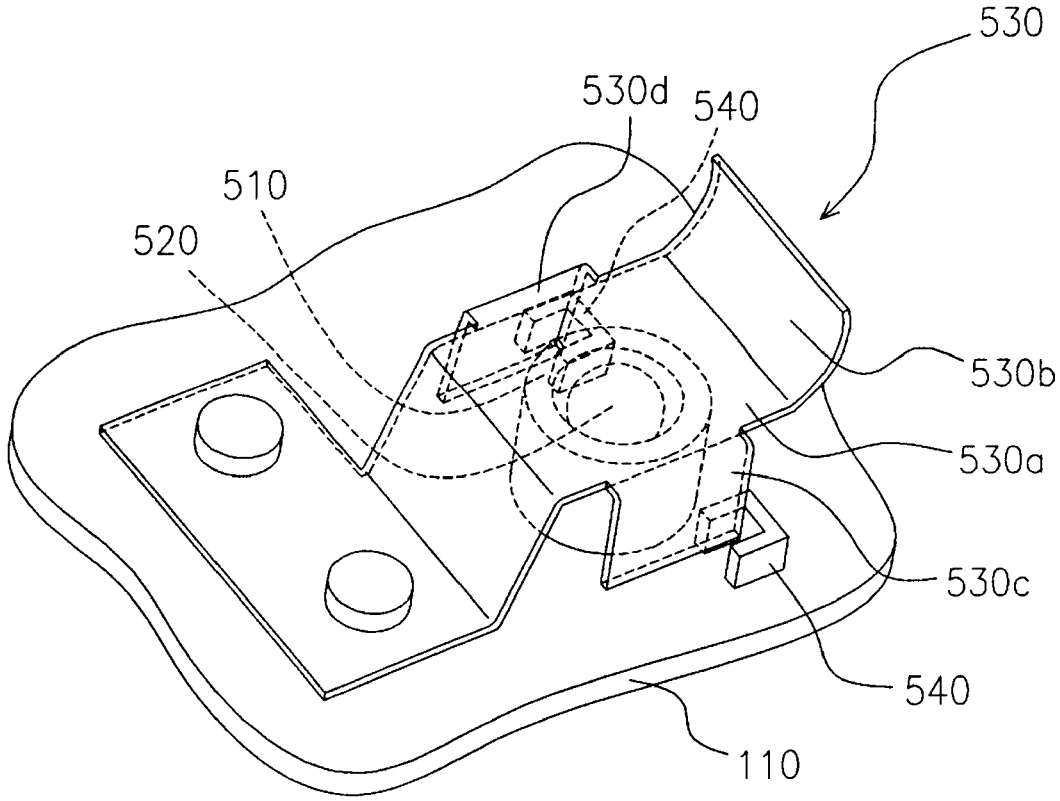

FIGS. 5B is a perspective view of a portion of another pressure control device according to a third embodiment of this invention. To limit the moving range of the first section 530*a*, a fourth section 530*d* having a similar configuration as the third section 530*c* may also be attached to the other side of the first section 530*a* apart from the third section 530*c* as shown in FIG. 5A. Similarly, a limiting structure 542 is also set up along the moving path of the fourth section 530*d* to constrain its moving range. In brief, the limiting structure 540 and the limiting structure 542 are set up along the trajectory of the third section 530*c* and the fourth section 530*d*, thereby limiting their moving range and the moving range of the first section 530*a* correspondingly.

In the third embodiment of this invention, the pressure control device incorporates a third section into the spring-loaded structure and sets up a corresponding limiting structure inside the ink reservoir. When negative pressure inside the ink reservoir changes, the pressure regulator pushes the second section of the spring-loaded structure forward so that the third section of the spring-loaded structure also moves correspondingly. The limiting structure is set up along the moving path of the third section to restrict its moving range, thereby limiting the movement of the first section as well. Since the maximum separation between the first section arid the upper end of the vent is limited to a value smaller the diameter of the plugging block, the plugging block is prevented from jumping off.

In conclusion, the pressure control device according to this invention and a conventional pressure regulator may be used in tandem to control the negative pressure inside the ink reservoir. Furthermore, additional sections and corresponding limiting structures for limiting the range of movement of the first section may also be incorporated into the spring-loaded structure. Consequently, the maximum separation between the first section and the upper end of the nozzle stand is set to be smaller than the diameter of the plugging block. Hence, when the pressure plate of the pressure regulator pushes the second section too hard due to external pressure or sudden impact, dislocation of the plugging block is prevented and functionality of the pressure control device is maintained.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A pressure control device inside an ink reservoir for maintaining a negative pressure together with a pressure regulator, the pressure control device comprising:

a vent on a interior wall of the ink reservoir, wherein the vent has a hole for linking up the interior of the ink reservoir with the exterior and a groove at the upper end of the hole;

a plugging block positioned inside the groove for isolating the interior of the ink reservoir from the exterior; and a spring-loaded structure mounted onto the interior wall of the ink reservoir, wherein the spring-loaded structure includes a first section and a second section connected to each other, the first section presses on the outer edge of the plugging block elastically and the second section couples with the pressure regulator, when the negative pressure inside the ink reservoir changes, the pressure regulator pushes the second section of the spring-loaded structure and lifts the first section off from the outer edge of the plugging block, and the spring-loaded structure further includes a third section connected to the second section, one end of the third section runs along the direction of movement of the pressure regulator and extends towards the interior wall of the ink reservoir but separate from the wall by a short distance so that a range of movement for the third section and hence the second section and the first section are all limited.

2. The pressure control device of claim 1, wherein the exterior of the ink reservoir is the atmosphere.

3. The pressure control device of claim 1, wherein the plugging block includes a ball-shaped object.

4. The pressure control device of claim 1, wherein the plugging block is a steel ball.

5. A pressure control device inside an ink reservoir for maintaining a negative pressure, the pressure control device comprising:

a vent mount on an interior wall of the ink reservoir, wherein a nozzle stand has a hole that connects the interior of the ink reservoir with the exterior, and the nozzle hole also has a groove at the upper end of the nozzle hole;

a plugging block positioned inside the groove for isolating the interior of the ink reservoir from the exterior;

a spring-loaded structure mounted on the interior wall of the ink reservoir, the spring-loaded structure includes a first section and a second section connected to each other, the first section presses on the outer edge of the plugging block elastically and the second section couples with the pressure regulator, when the negative pressure inside the ink reservoir changes, the pressure regulator pushes the second section of the spring-loaded structure and lifts the first section of the spring-loaded structure off the outer edge of the plugging block; and at least one limiting structure installed somewhere along the moving path of the spring-loaded structure so that a range of movement of the spring-loaded structure is restricted.

6. The pressure control device of claim 5, wherein the exterior of the ink reservoir is the atmosphere.

7. The pressure control device of claim 5, wherein the plugging block includes a ball-shaped object.

8. The pressure control device of claim 5, wherein the plugging block is a steel ball.

9. The pressure control device of claim 5, wherein the limiting structure is setup somewhere along the moving trajectory of the first section of the spring-loaded structure so that the moving range of the first section is confined.

10. The pressure control device of claim 9, wherein the limiting structure further includes:

at least one pad block attached to the interior wall of the ink reservoir; and a stopper block having one end attached to the upper surface of the pad block while the other end extends out to cross the moving path of the first section of the spring-loaded structure.

11. The pressure control device of claim 10, wherein the pad block and the interior wall of the ink reservoir are formed together as an integrative unit.

12. The pressure control device of claim 5, wherein the spring-loaded structure further includes a third section such that when the negative pressure inside the ink reservoir changes, the pressure regulator pushes the second section of the spring-loaded structure and drives the third section of the spring-loaded structure due to coupling, meanwhile, the limiting structure is set up somewhere crossing the path of movement of the third section so that moving range of the third section is restricted, and ultimately, the moving range of the first section is also limited.

13. The pressure control device of claim 12, wherein the third section of the spring-loaded structure is coupled to the first section.

14. The pressure control device of claim 12, wherein the limiting structure and the interior wall of the ink reservoir are formed together as an integrative unit.

* * * * *